US005678756A

United States Patent [19]

Sugiura

[11] Patent Number: 5,678,756

[45] Date of Patent: Oct. 21, 1997

[54] ENVELOPE

[75] Inventor: Masaki Sugiura, Osaka, Japan

[73] Assignee: Haguruma Envelope Mfg. Co., Ltd., Osaka, Japan

[21] Appl. No.: 654,112

[22] Filed: May 28, 1996

[51] Int. Cl.[6] ..... B65D 27/34

[52] U.S. Cl. ..... 229/313; 229/92.8; 40/750; 40/789

[58] Field of Search ..... 229/92.8, 313, 229/84; 40/124.1, 750, 789

[56] References Cited

U.S. PATENT DOCUMENTS

| | | | |
|---|---|---|---|
| 1,347,269 | 7/1920 | Greble | 229/92.8 X |
| 2,219,492 | 10/1940 | Prichap | 229/92.8 X |
| 4,780,975 | 11/1988 | Friedman | 229/92.8 X |
| 5,337,949 | 8/1994 | Seeley | 229/92.8 |
| 5,439,101 | 8/1995 | Brink et al. | 40/789 X |

FOREIGN PATENT DOCUMENTS

| | | | |
|---|---|---|---|
| 12272 | 6/1904 | United Kingdom | 229/92.8 |

*Primary Examiner*—Jes F. Pascua

*Attorney, Agent, or Firm*—Wenderoth Lind & Ponack

[57] ABSTRACT

An envelope can be used as a photo stand in a stable manner. It is made up of a frame panel having a window, a retaining panel that forms, in cooperation with the frame panel, a photo-receiving portion in the shape of a bag, and a leg-forming panel connecting with the photo-receiving portion and having a sealing flap on one side thereof. The sealing flap is formed with two cut lines that extend longitudinally over the entire length of the sealing flap to define an unsealing strip therebetween. The leg-forming panel has supporting legs defined by discontinuous cuts. The photo-receiving portion is formed with slits adapted to engage the legs along its bottom edge.

15 Claims, 8 Drawing Sheets

ENVELOPE

BACKGROUND OF THE INVENTION

This invention relates to an envelope which can also be used as a photo stand.

To mail a photo to someone, it is usually sent in an envelope. If the recipient wants to display the photo on a desk or the like, he or she has to take the photo out of the envelope and set it in a separate photo stand.

If no such photo stand is at hand, or if any photo stand at hand is not the right size, it is necessary to buy a new one.

An object of this invention is to provide an envelope which can be used as a photo stand as well, i.e. an envelope which can be erected stably with a photo supported thereon, like an ordinary photo stand.

SUMMARY OF THE INVENTION

According to this invention, there is provided an envelope comprising a frame panel having a window formed therein , a retaining panel that cooperates with the frame panel to form a photo-receiving portion, and a leg-forming panel connecting with the retaining panel and having a sealing flap on one side thereof. The sealing flap is formed with two cut lines that extend longitudinally over the entire length of the sealing flap to define an "unsealing" strip therebetween. The leg-forming panel has supporting legs defined by discontinuous cuts. The photo-receiving portion is formed with slits adapted to engage the legs along its bottom edge.

To seal the envelope, the leg-forming panel is folded to superpose it on the panel frame, and then the sealing flap is folded back and bonded with an adhesive.

The envelope can be opened by tearing off the unsealing strip of the sealing flap.

The legs are separated along the discontinuous cuts, raised and engaged in the slits to support the photo-receiving portion.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Embodiments are now described with reference to the drawings.

Figure 1:
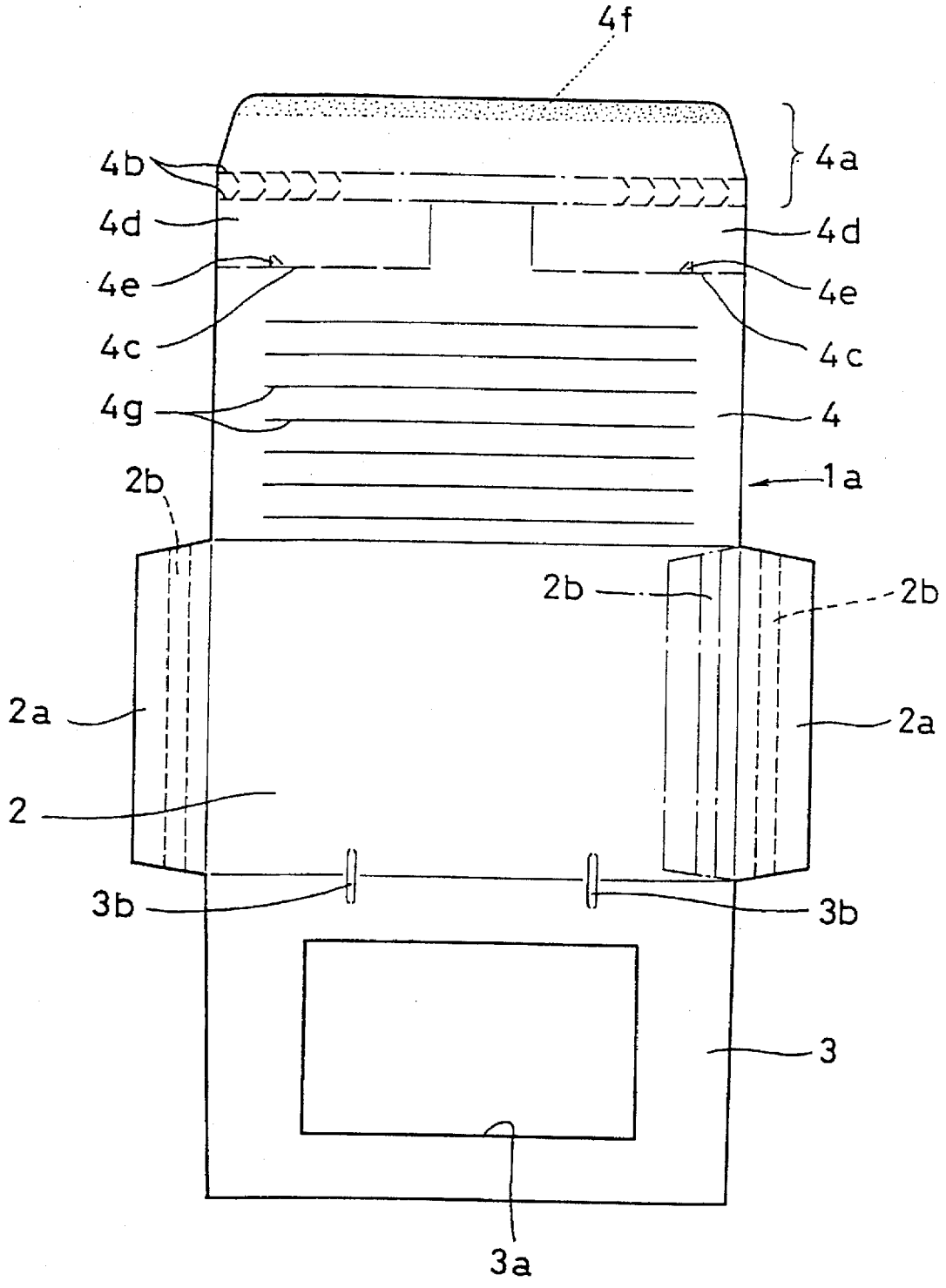
FIG. 1 is a plan view of a blank to be formed into an envelope of a first embodiment according to this invention.

FIG. 1 shows a blank or a developed form of the envelope according to this invention. As shown, the blank 1*a* comprises a rectangular retaining panel 2, a frame panel 3 having the same configuration as the panel 2 and provided on one side of the panel 2, and a leg-forming panel 4 having the same configuration as the panel 2 and provided on the other side of the panel 2. The retaining panel 2 has flaps 2*a* at both ends thereof. The leg-forming panel 4 has a sealing flap 4*a* along its side edge remote from the panel 2.

The frame panel 3 has a window 3*a* through which a photo set behind the panel 3 can be seen. The window 3*a* may be rectangular as shown, heart-shaped, or shaped otherwise.

Each flap 2*a* has a strip of adhesive layer 2*b* on its back so that these layers 2*b* are positioned between both ends of the frame panel 3 and both ends of the window 3*a* when the flaps 2*a* are folded so that they overlap the retaining panel 2 as shown by chain lines in FIG. 1.

The leg-forming panel 4 has a discontinuous through cut 4*c* that extends in juxtaposition with its side edge remote from the panel 2. Two parallel cut lines 4*b* are formed in the sealing flap 4*a*. A pair of legs 4*d* are defined between the cut 4*c* and the cut lines 4*b*. Discontinuous cuts are formed in each leg 4*d*. A notch 4*e* is formed by removing the portion defined between the cuts formed in each leg 4*d*.

Two pairs of discontinuous through cuts are formed to bridge the retaining panel 2 and the frame panel 3. A pair of slits 3*b* are formed by removing the portions defined between the respective pairs of cuts. The slits 3*b* are adapted to engage the legs 4*d* in a manner described later.

An adhesive layer 4*f* may be provided on the sealing flap 4*a*. Lines 4*g* may be printed on the leg-forming panel 4 to provide a message-writing space on the panel 4.

Figure 2:
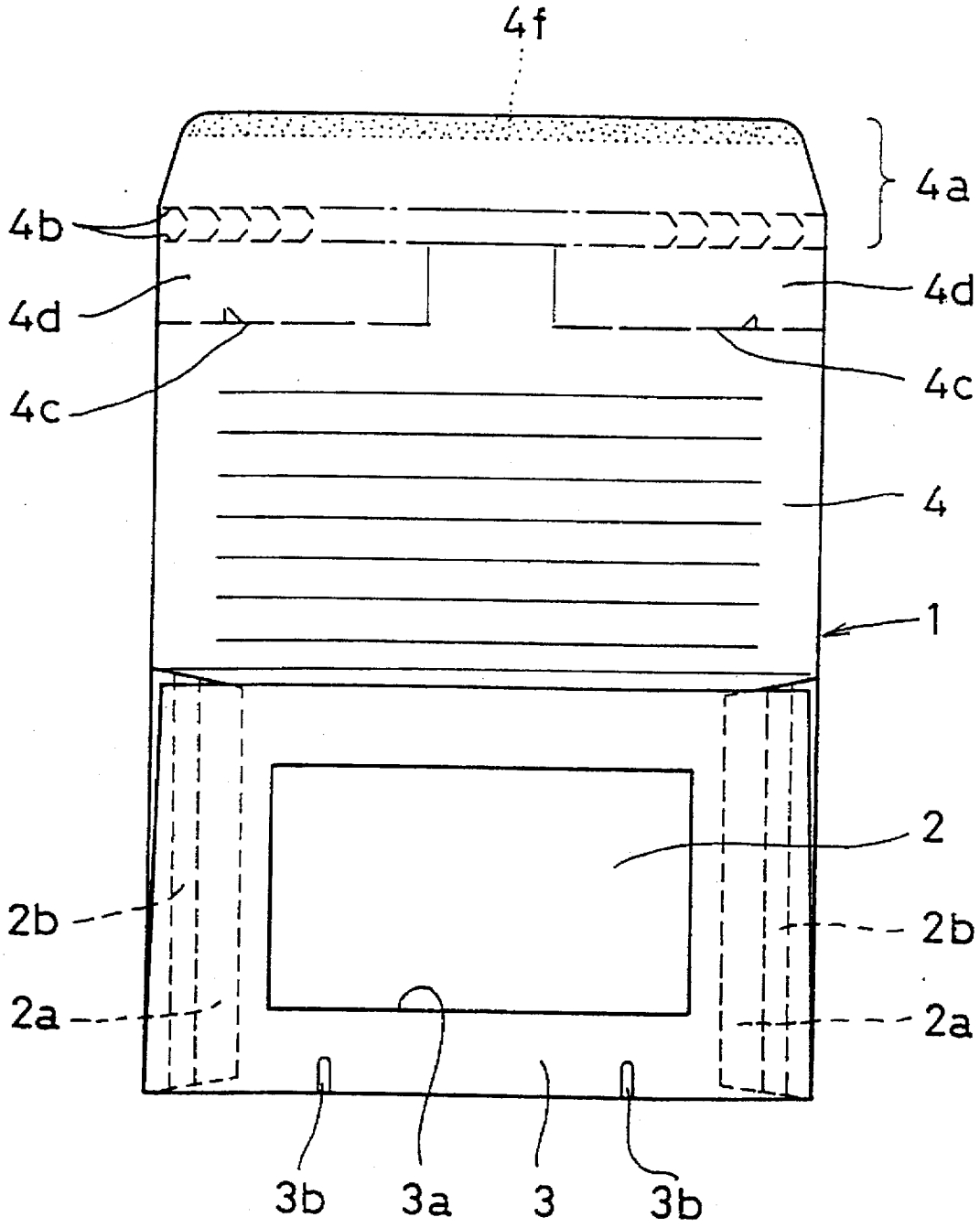
FIG. 2 is a plan view of the envelope according to this invention.

To form an envelope from the blank la, the flaps 2*a* of the retaining panel 2 are folded inward to superpose them on the panel 2 as shown in FIG. 1 by dotted lines. In this state, the adhesive layers 2*b*, provided on the backs of the flaps 2*a*, will come to the front side. The frame panel 3 is then folded until it overlaps the retaining panel 2 to bond it to the flaps 2*a* through the adhesive layers 2*b*. As shown in FIG. 2, the envelope 1 thus formed has a bag-shaped photo-receiving space defined by the retaining panel 2, flaps 2 and frame panel 3. A photo is inserted into the photo-receiving space through its opening near the leg-forming panel 4. In order to stably support a photo in the photo-receiving space,. the adhesive layers 2*b* are preferably spaced a distance substantially equal to the width of a photo to be put in the space (e.g. a photo of an ordinary size).

Figure 3:
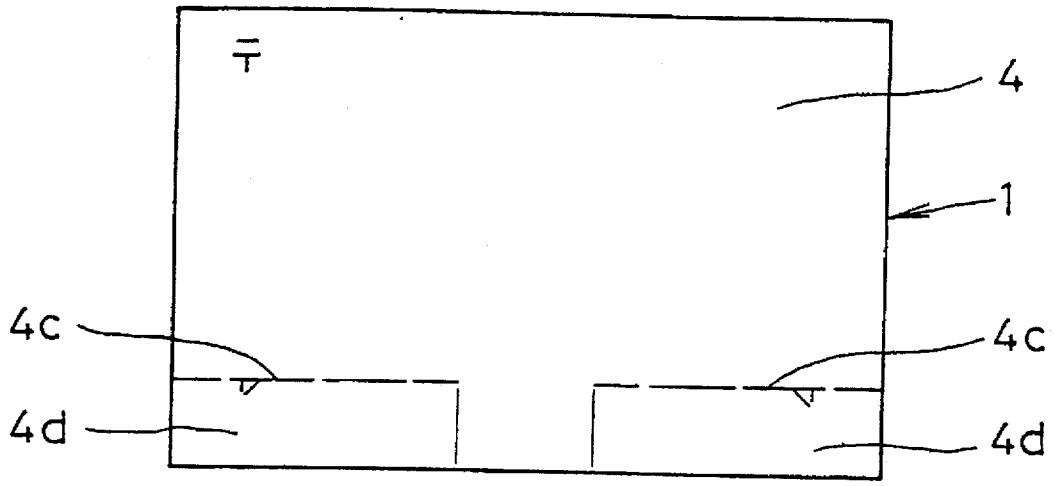
FIG. 3 is a plan view of the envelope of FIG. 2 showing its sealed state.
Figure 4:
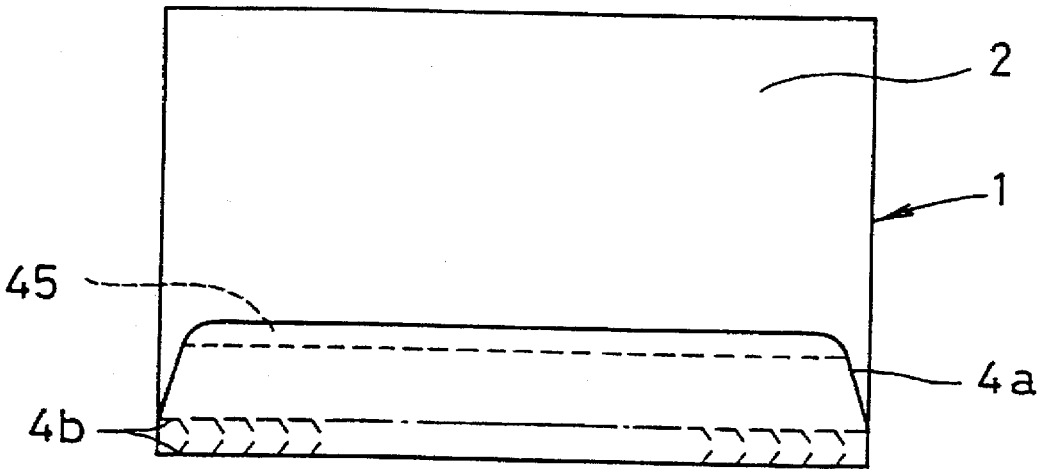
FIG. 4 is its backside view.

With a photo inserted in the envelope 1, the leg-forming panel 4 is folded toward the frame panel 3 (photo-receiving space) to superimpose it on the panel 3. In this state, the sealing flap 4*a* is folded so as to overlap the back of the retaining panel 2. Then, the adhesive layer 4*f* is bonded to the retaining panel 2, or if the flap 4*a* has no such adhesive layer 4*f*, the portion corresponding to the adhesive layer 4*f* is bonded to the panel 2 with an adhesive. The envelope 1 is now sealed as shown in FIGS. 3 and 4. FIG. 3 shows the front of the sealed envelope, while FIG. 4 shows its back.

To open the envelope 1, the unsealing strip defined between the two cut lines 4*b* are torn off over its entire length, i.e. from one end of the flap 4*a* to its other end, by pulling the strip with the fingers.

Since the flap 4*a* is bonded only at its upper portion 4*f*, the envelope can be unsealed by removing the unsealing strip between the cut lines 4*b*.

As shown in FIG. 3, the leg-forming panel 4 forms the front face of the sealed envelope. The envelope is now open along its side edge where the flap 4a is formed due to the removal of unsealing strip. In this state, the legs 4d are separated from the panel 4 along the cuts 4c and folded toward the back of the envelope 1 (i.e. toward the retaining panel 2 in FIG. 4).

Figure 5:
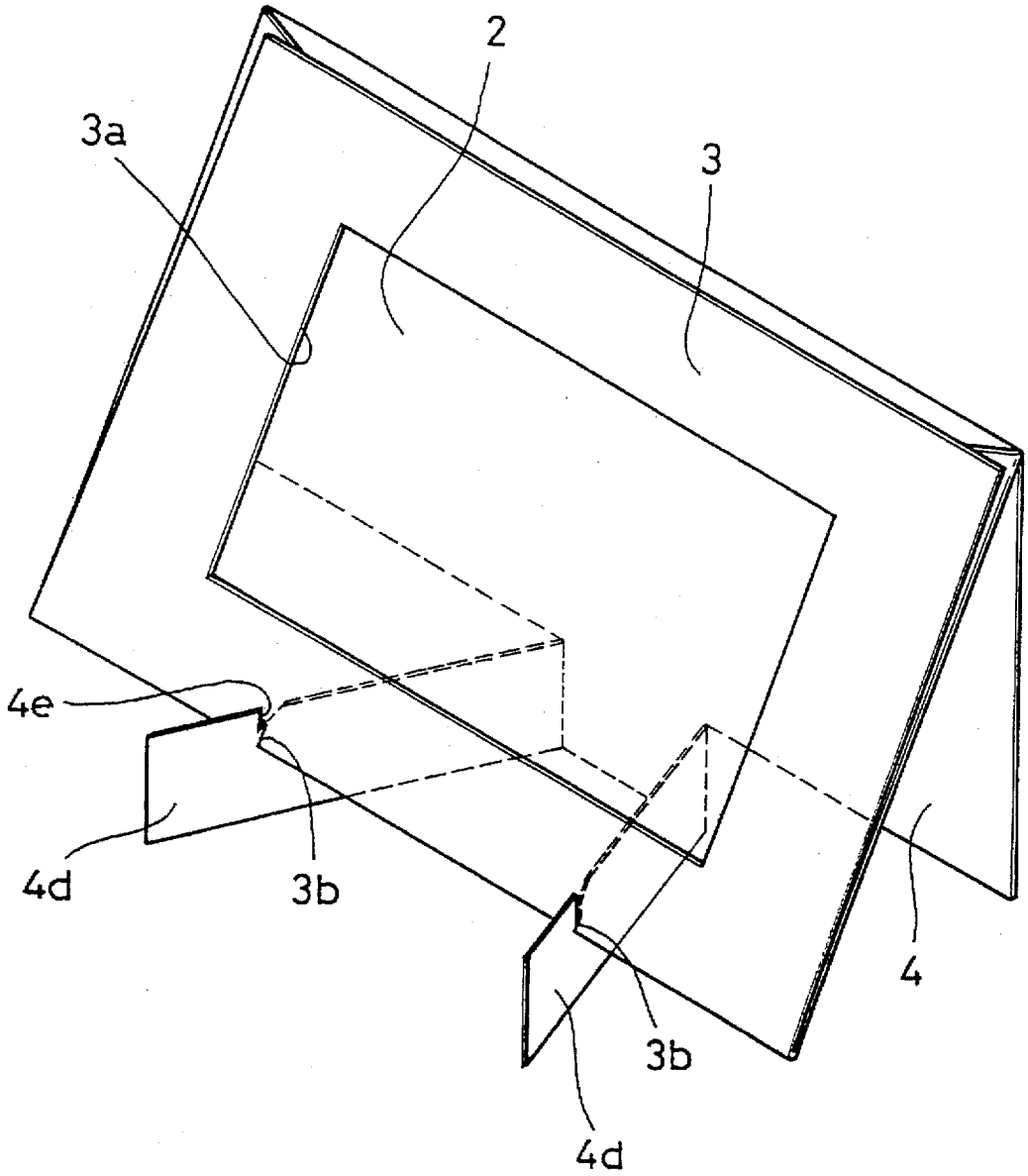
FIG. 5 is a perspective view of the same when it is opened and used as a photo stand.

Then, as shown in FIG. 5, the portions defined between the cuts formed along the lower edge of the frame panel 3 are removed to form the slits 3b. The legs 4d are bent toward the frame panel 3 to engage them in the slits 3b. If the legs 4d have the notches 4e as shown in FIG. 1, they can be more stably held in position by engaging the notches 4e with the slits 3b.

With the legs 4d engaged in the slits 3b, they support the bottom edge of a photo (not shown) set in the photo-receiving space defined by the retaining panel 2 and the frame panel 3, thus holding the photo in position.

Either the slits 3b or the notches 4e may be omitted.

FIGS. 6 to 10 show another embodiment.

Figure 6:
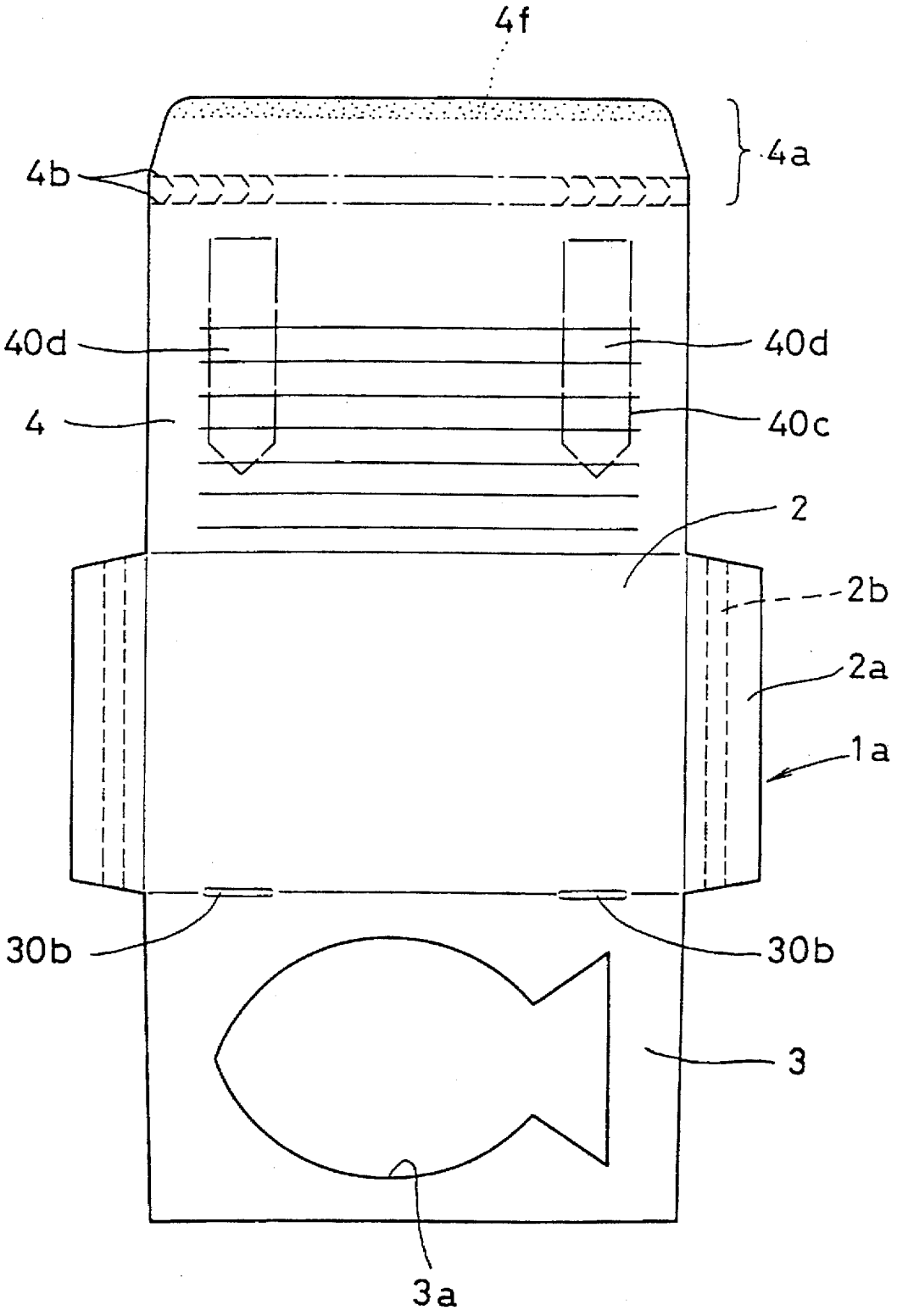
FIG. 6 is a plan view of a blank to be formed into an envelope of a second embodiment of this invention.

FIG. 6 shows a blank which can be folded into the shape of an envelope. In the figure, the same elements shown in FIG. 1 are denoted by the same numerals and their description is omitted. As shown, discontinuous cuts 40c that define supporting legs 40d are formed in the leg-forming panel 3 to extend in the transverse direction thereof. Cuts that define slits 30b adapted to engage the legs 40d are formed along one side edge of the retaining panel 2.

The frame panel 3 has a fish-shaped window 3a.

Figure 7:
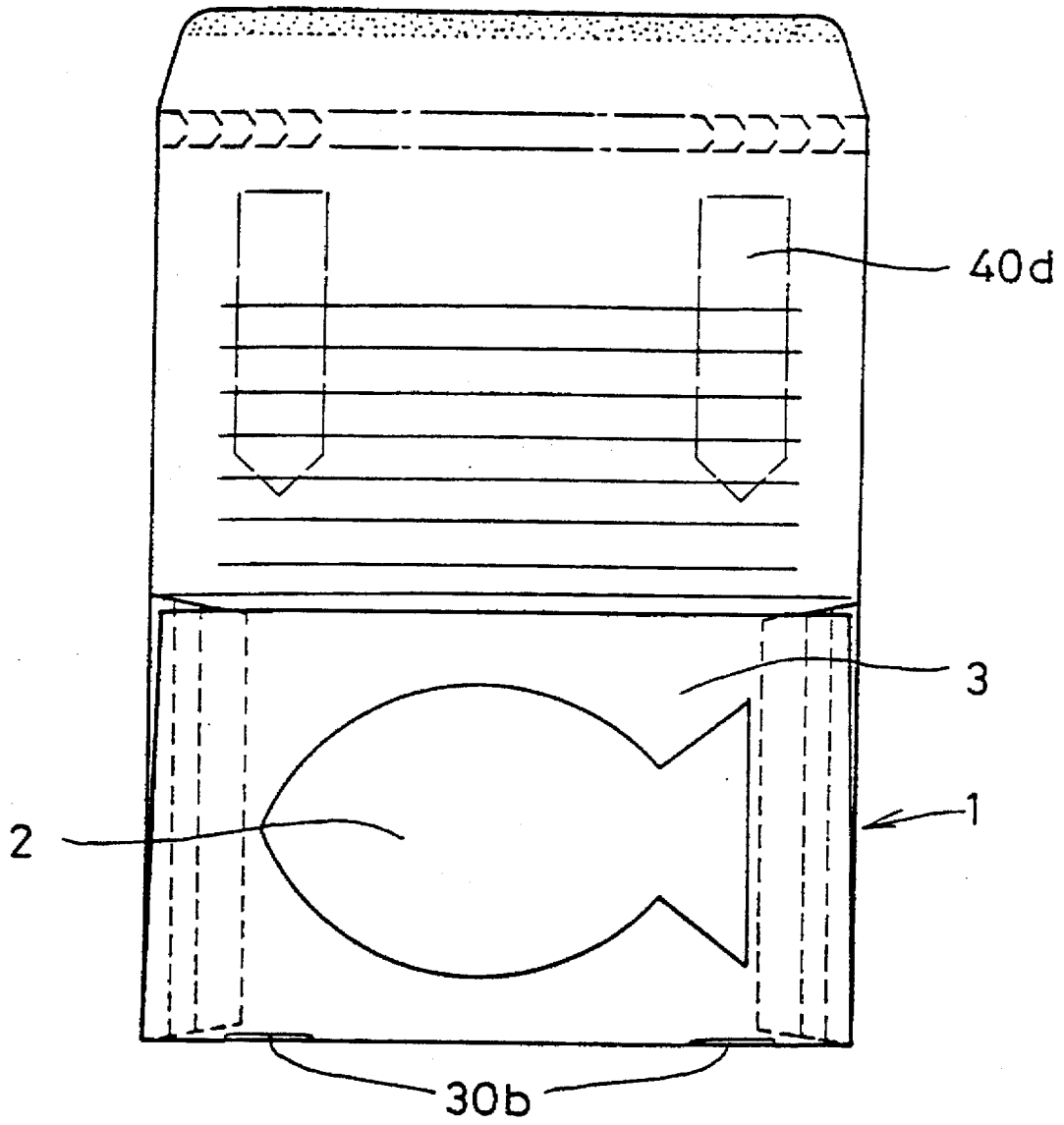
FIG. 7 is a plan view of the envelope of the second embodiment.

FIG. 7 shows the envelope formed by folding the blank 1a.

Figure 8:
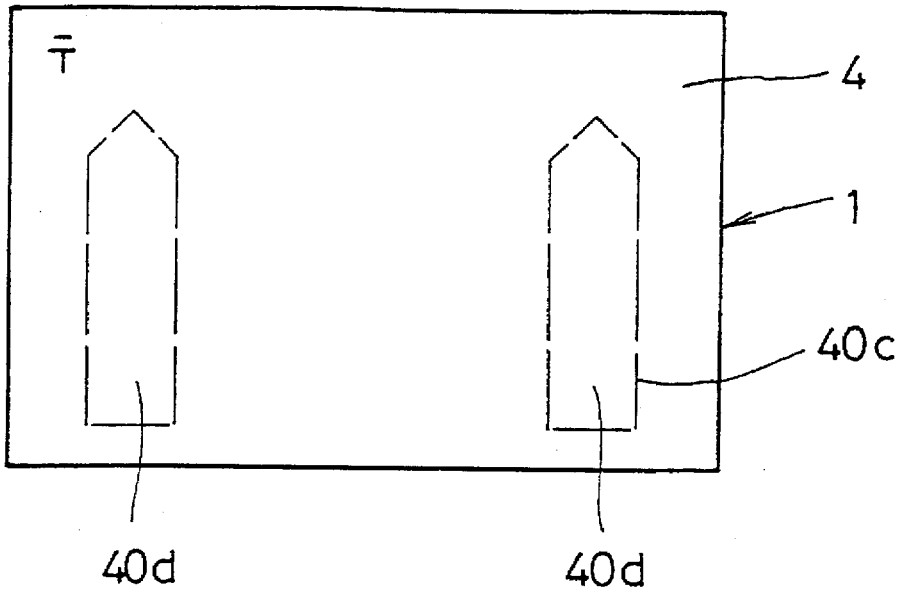
FIG. 8 is a plan view of the envelope of FIG. 7 showing its sealed state.
Figure 9:
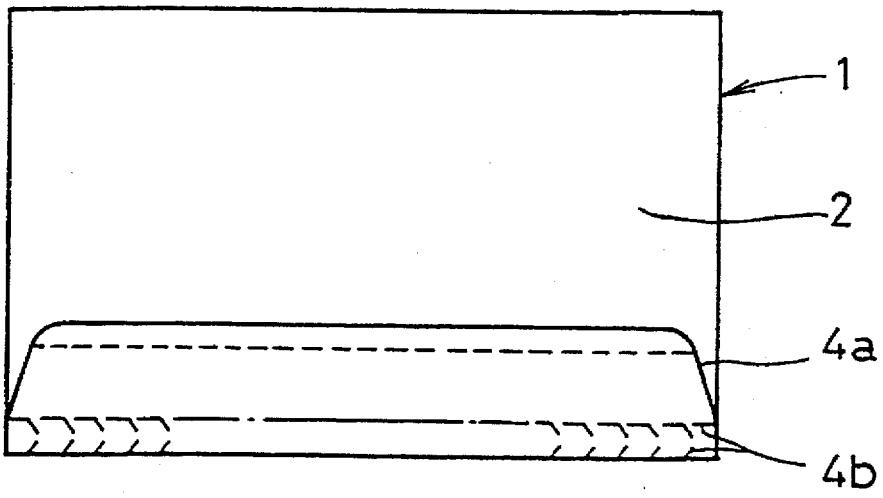
FIG. 9 is its backside view.

FIG. 8 shows the front side of the envelope 1 sealed after putting a photo therein. FIG. 9 shows its back.

The envelope 1 can be opened in the same manner as in the first embodiment. That is, the unsealing strip defined between the cut lines 4b are torn off from one end of the sealing flap 4a to its other end by pulling the strip with fingers.

Figure 10:
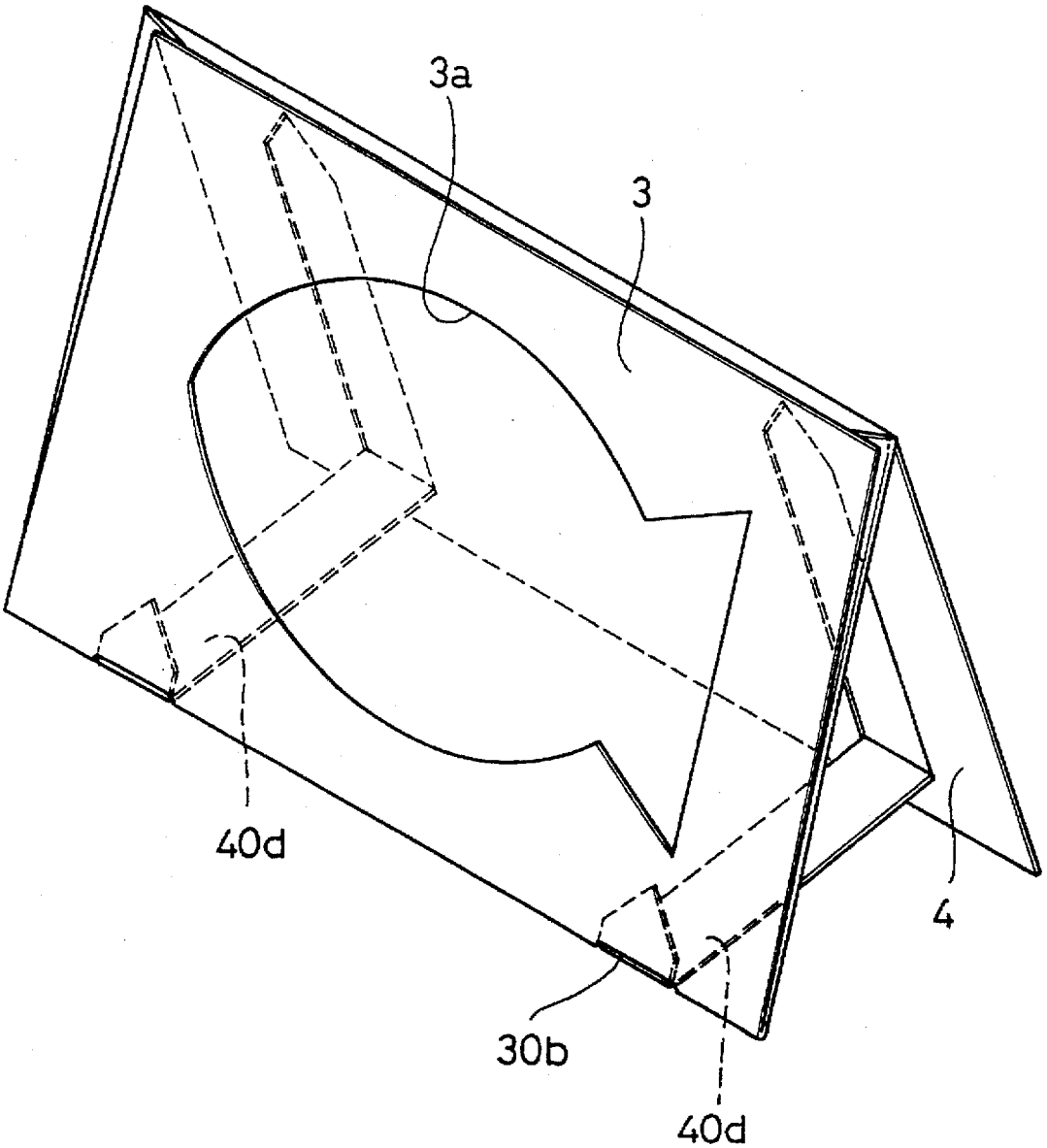
FIG. 10 is a perspective view of the same, when it is opened and used as a photo stand.

The leg-forming panel 4, whose bottom edge has been freed by tearing off the unsealing strip, is folded back about its top edge so as to face the retaining panel 4. The legs 40d are then separated from the panel 4 along the discontinuous cuts 40c and bent forward and their tips are inserted into the slits 30b as shown in FIG. 10. In this state, the tips of the legs 40d abut the bottom edge of the photo (not shown), holding the photo in position.

This invention makes it possible to use an envelope used to send a photo as a photo stand. Thus, no separate photo stand is needed to display the photo. Such an envelope is simple in structure and cheap. Still, it is so sturdy that it can be stably used as a photo stand for a long time.

What is claimed is:

1. An envelope comprising:

a frame panel having a window formed therein;

a retaining panel cooperable with said frame panel to form a photo receiving portion having a bottom edge; and a leg forming panel connected with said retaining panel, said leg forming panel having a sealing flap along one side thereof;

wherein said sealing flap has two cut lines that extend longitudinally over the entire length of said sealing flap so as to define an unsealing strip between said two cut lines;

wherein said leg forming panel comprises discontinuous cuts therein defining supporting legs; and wherein said photo receiving portion comprises slits along said bottom edge thereof adapted to engage with said supporting legs.

2. The envelope of claim 1, said frame panel has a bottom edge along which said frame panel is connected to said retaining panel and along which said slits are formed.

3. The envelope of claim 2, wherein said retaining panel has a bottom edge along which said retaining panel is connected to said frame panel, said slits extending into said frame panel and said retaining panel.

4. The envelope of claim 1, wherein said retaining panel comprises flaps along sides thereof, said flaps having adhesive thereon and being adapted to be folded in over said retaining panel so as to adhere with said frame panel and form said photo receiving portion.

5. The envelope of claim 1, wherein said retaining panel has a bottom edge along which said retaining panel is connected to said frame panel and a top edge along which said retaining panel is connected to said leg forming panel.

6. The envelope of claim 5, wherein said retaining panel comprises flaps along sides thereof, said flaps having adhesive thereon and being adapted to be folded in over said retaining panel so as to adhere with said frame panel and form said photo receiving portion.

7. The envelope of claim 6, wherein said leg forming flap has a second side at which said leg forming flap is connected to said retaining panel, said second side being opposite to said one side of said leg forming flap.

8. The envelope of claim 1, wherein said discontinuous cuts in said leg forming panel comprise two sets of cuts each partly defining a two dimensional shape having a side without cuts for maintaining a connection between the two dimensional shape and the remainder of said leg forming panel.

9. The envelope of claim 8, wherein said leg forming panel has a second side at which said leg forming flap is connected to said retaining panel, said second side being opposite to said one side of said leg forming flap, and lateral sides between said one and said second sides, wherein said discontinuous cuts extend from each of said lateral sides to a point short of a lateral midpoint of said leg forming panel, and wherein said supporting legs are further defined by one of said two cut lines of said sealing flap.

10. The envelope of claim 8, wherein said leg forming panel has a second side at which said leg forming flap is connected to said retaining panel, said second side being opposite to said one side of said leg forming flap, and wherein said discontinuous cuts extend in said leg forming panel from points between said one and said second sides toward said second side.

11. A blank for forming an envelope, comprising:

a frame panel having a window formed therein and a bottom side;

a retaining panel having a bottom side and a top side, and cooperable with said frame panel to form a photo receiving portion having a bottom edge, said retaining panel and said frame panel being connected along said bottom sides thereof to form said bottom edge; and a leg forming panel connected with said top side of said retaining panel, said leg forming panel having a sealing flap along one side thereof and being connected with said retaining panel along a second side thereof opposite to said one side;

wherein said sealing flap has two cut lines that extend longitudinally over the entire length of said sealing flap so as to define an unsealing strip between said two cut lines;

wherein said leg forming panel comprises discontinuous cuts therein defining portions of said leg forming panel capable of use as supporting legs; and wherein said retaining panel and said frame panel have slits along said bottom sides thereof whereby when said retaining panel and said frame panel cooperate to from the photo receiving portion, the photo receiving portion will comprise slits along said bottom edge thereof adapted to engage with the supporting legs.

12. The blank of claim 11, wherein said retaining panel comprises flaps along sides thereof, said flaps having adhesive thereon and being adapted to be folded in over said retaining panel so as to adhere with said frame panel and form the photo receiving portion.

13. The envelope of claim 11, wherein said discontinuous cuts in said leg forming panel comprise two sets of cuts each partly defining a two dimensional shape having a side without cuts for maintaining a connection between the two dimensional shape and the remainder of said leg forming panel.

14. The envelope of claim 13, wherein said leg forming flap has lateral sides between said one and said second sides, wherein said discontinuous cuts extend from each of said lateral sides to a point short of a lateral midpoint of said leg forming panel, and wherein said supporting legs are further defined by one of said two cut lines of said sealing flap.

15. The envelope of claim 13, wherein said discontinuous cuts extend in said leg forming panel from points between said one and said second sides toward said second side.

* * * * *